US007432899B2

(12) United States Patent
Johnson

(10) Patent No.: US 7,432,899 B2
(45) Date of Patent: Oct. 7, 2008

(54) DRIVING SCHEME FOR CHOLESTERIC LIQUID CRYSTAL DISPLAY

(75) Inventor: David M. Johnson, West Henrietta, NY (US)

(73) Assignee: Industrial Technology Research Institute, Hsinchu (TW)

( * ) Notice: Subject to any disclaimer, the term of this patent is extended or adjusted under 35 U.S.C. 154(b) by 598 days.

(21) Appl. No.: 10/845,704

(22) Filed: May 14, 2004

(65) Prior Publication Data

US 2005/0253875 A1 Nov. 17, 2005

(51) Int. Cl.
*G09G 3/36* (2006.01)

(52) U.S. Cl. ..... 345/94; 345/87; 345/89; 345/97; 345/690

(58) Field of Classification Search ..... 345/89, 345/94, 55–100, 204–214, 690–693
See application file for complete search history.

(56) References Cited

U.S. PATENT DOCUMENTS

| | | | | |
|---|---|---|---|---|
| 5,251,048 | A | 10/1993 | Doane et al. | 359/51 |
| 5,644,330 | A | 7/1997 | Catchpole et al. | 345/95 |
| 5,748,277 | A | 5/1998 | Huang et al. | 349/169 |
| 6,154,190 | A | 11/2000 | Yang et al. | 345/94 |
| 6,268,840 | B1 | 7/2001 | Huang | 345/94 |
| 6,414,666 | B1 | 7/2002 | Yamakawa et al. | 345/95 |
| 2001/0045933 | A1 * | 11/2001 | Sakaigawa et al. | 345/98 |
| 2002/0109661 | A1 | 8/2002 | Blackson et al. | 345/97 |
| 2003/0085863 | A1 | 5/2003 | Ma | 345/97 |
| 2006/0279501 | A1 * | 12/2006 | Lu et al. | 345/94 |

FOREIGN PATENT DOCUMENTS

EP 1283435 7/2002

OTHER PUBLICATIONS

A. Rybalochka, V. Sorokin, S. Valyukh, A. Sorokin, "Dynamic Drive Scheme For Fast Addressing Cholesteric Displays", 2000, pp. 818-821.
A. Rybalochka, V. Sorokin, S. Valyukh, A. Sorokin, "Simple Drive Scheme for Bistable Cholesteric LCDs", 2001, pp. 882-885.
Anonymous, "Polymer Stabilized Cholestric Liquid Crystal", Apr. 21, 2004, whole document.

* cited by examiner

*Primary Examiner*—David L Lewis
(74) *Attorney, Agent, or Firm*—Alston & Bird LLP

(57) ABSTRACT

A drive scheme is described for a display capable of gray scale. Multiple two-level pulses are used in conjunction with dynamic relaxation techniques to write pixels ON or OFF and to adjust the gray level of pixels. Only two voltage levels are used, a maximum level U, and a minimum level 0. This reduces the complexity of the electronics so that the only one voltage generator is needed for the display.

14 Claims, 11 Drawing Sheets

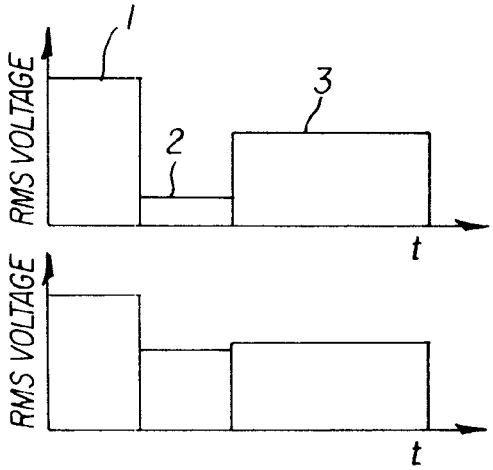
FIG. 1A
(Prior Art)
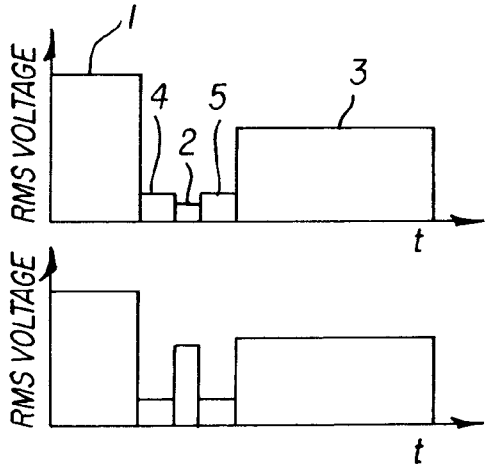
FIG. 1B
(Prior Art)
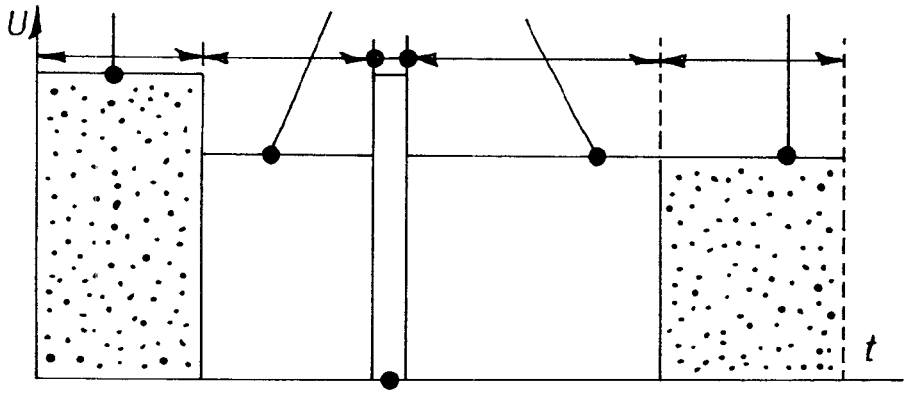
FIC. 1C
(Prior Art)

GRAY SCALE VALUES (EQUAL SUB SELECTION)

GRAY SCALE VALUES (UNEQUAL SUB SELECTION)

DRIVING SCHEME FOR CHOLESTERIC LIQUID CRYSTAL DISPLAY

FIELD OF THE INVENTION

Electrical drive schemes which enable high-speed gray scale writing of cholesteric (chiral nematic) liquid crystal displays are provided.

BACKGROUND OF THE INVENTION

Information can be displayed on electronically modulated surfaces such as liquid crystal displays (LCDs). Such displays can be used for signage, shelf labels, or large scale displays such as billboards.

Various types of LCDs are known in the art. Flat panel LCDs can use two transparent glass plates as substrates, as described in U.S. Pat. No. 5,503,952. Such displays are expensive and bulky. Flexible, electronically-written display sheets using nematic liquid crystals materials are disclosed in U.S. Pat. No. 4,435,047. The sheets can be thin glass, or a polymer, for example, Mylar polyester. The nematic liquid crystals require continuous electrical drive to remain transparent. U.S. Pat. No. 5,437,811 discloses a light-modulating cell having a chiral nematic liquid crystal (cholesteric liquid crystal, or ChLC) in polymeric domains contained by patterned glass substrates. The chiral nematic liquid crystal has the property of being driven between a planar state reflecting a specific visible wavelength of light, and a light scattering focal conic state. These two states are stable and can be maintained in the absence of an electric field. This enables larger displays.

Various drive schemes are known for use with liquid crystal displays. For example, U.S. Pat. Nos. 5,251,048 and 5,644,330 disclose driving methods to switch chiral nematic materials between stable states. However, the update rate of these displays is about 10-40 milliseconds per line of the display, which is too slow for most practical applications. For example, it would take 10-40 seconds to update a 1000 line display. U.S. Pat. Nos. 5,748,277 and 6,154,190 disclose fast driving schemes, called dynamic driving schemes, for chiral nematic displays. The dynamic driving schemes described include a preparation step 1, selection step 2, and evolution step 3, as shown in FIG. 1A, and optionally further include a pre-holding step 4 and a post-holding step 5 as shown in FIG. 1B. The driving schemes require complicated electronic driving circuitry. For example, all column and row drivers for a display must output bi-polar and multiple level voltages. The driving scheme results in the appearance of an undesirable black bar shifting across the display during image writing. U.S. Pat. No. 6,268,840 discloses a unipolar waveform drive method to implement the above-mentioned dynamic driving schemes. However, because the preparation step, the selection step, and the evolution step each require distinct voltage amplitudes, both column and row drivers are required to generate multilevel unipolar voltages.

Rybalochka et al. describes $U/\sqrt{2}$ dynamic driving schemes in Simple Drive Scheme for Bistable Cholesteric LCDs, SID 2001, pp. 882-885, and in Dynamic Drive Scheme for Fast Addressing of Cholesteric Displays, SID 2000, pp. 818-821. The $U/\sqrt{2}$ dynamic driving scheme requires a two-level column driver and a two-level row driver, which output either U or 0 voltage, as shown in FIGS. 1C and 1D. These drive schemes for producing focal conic or planar states do not produce undesirable black shifting bars during writing, but cause the entire frame to go black during the writing.

U.S. Patent Application Publication No. 2002/0109661 A1 discloses a drive scheme for a gray scale bistable cholesteric reflective display utilizing variable frequency pulses. The addressing method includes applying a predetermined number of pulses to a first plurality of electrodes, and applying a like number of the predetermined number of pulses to a second plurality of electrodes. Each of the predetermined number of pulses has a different frequency, wherein the predetermined number of pulses are applied within a set time period. This disclosure utilizes multiple voltage sources as well as multilevel display drivers, which adds cost and complexity to the power supply and display drivers.

U.S. Patent Application Publication No. 2003/0085863 A1 discloses a dynamic drive scheme wherein multiple voltages are used to supply a pulse to the liquid crystal between the transient planar state and the stable planar state to drive the display to the focal conic state. More than two voltages are used to derive the appropriate waveforms for the drive scheme. The use of the drive scheme as applied to gray scale displays is disclosed.

There is a need for a simple, low cost, and fast drive scheme for cholesteric liquid crystal displays that is capable of achieving a gray scale of multiple gray levels using a two-level voltage driving method.

SUMMARY OF THE INVENTION

A method of forming a gray scale on a bistable liquid crystal material display is presented, wherein the method includes applying a first number of pulses to a first plurality of electrodes, and applying a second number of pulses to a second plurality of electrodes, wherein each pulse has the same voltage.

ADVANTAGES

A low cost, effective, and fast gray scale dynamic driving scheme is presented wherein both row and column drivers require only two voltage outputs: U or 0. This reduces power supply and complexity requirements.

BRIEF DESCRIPTION OF THE DRAWINGS

The invention can be understood with reference to the following exemplary drawings:

FIG. 1A is 3-phase dynamic drive scheme (prior art);

FIG. 1B is 5-phase dynamic drive scheme (prior art);

FIG. 1C is a phase diagram of a $U/\sqrt{2}$ dynamic driving scheme (prior art);

DETAILED DESCRIPTION OF THE INVENTION

A low cost, effective, and fast gray scale dynamic driving scheme for a liquid crystal display is described. In the driving scheme, both row and column drivers require only two voltage outputs, U or 0, reducing power supply and complexity requirements.

As used herein throughout, row voltage is referred to as Urow, and column voltage is referred to as Ucolumn. Urow and Ucolumn can be the same or different. However, both Urow and Ucolumn can be referenced herein as U.

Figure 1D:
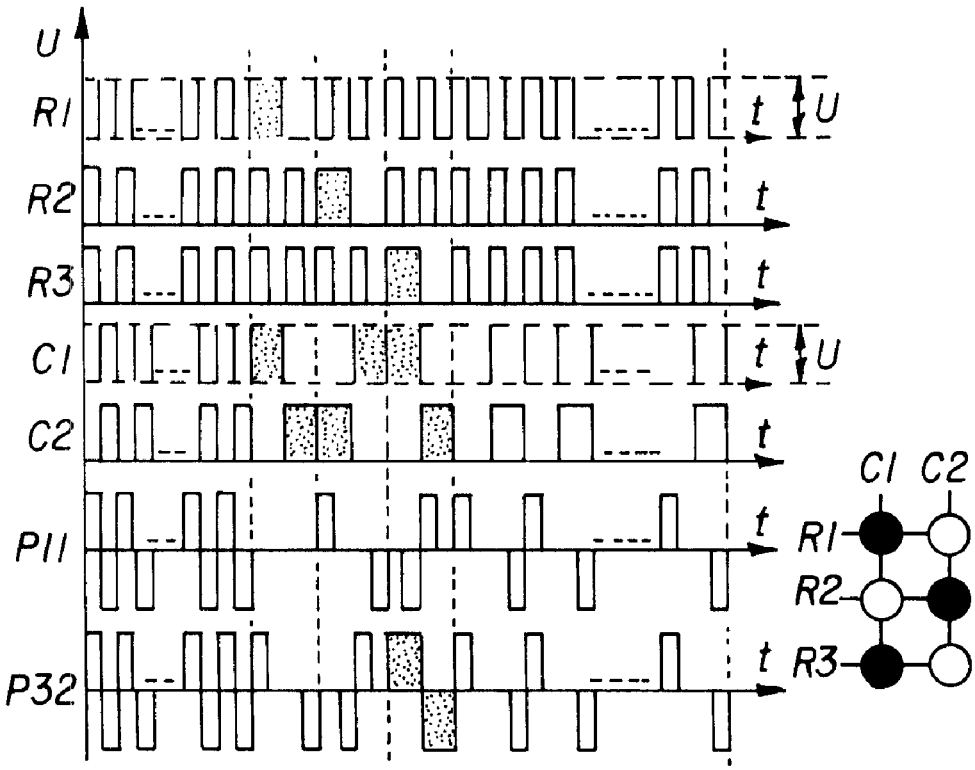
FIG. 1D (Prior Art)
FIG. 1D illustrates a $U/\sqrt{2}$ dynamic driving scheme (prior art)
Figure 2:
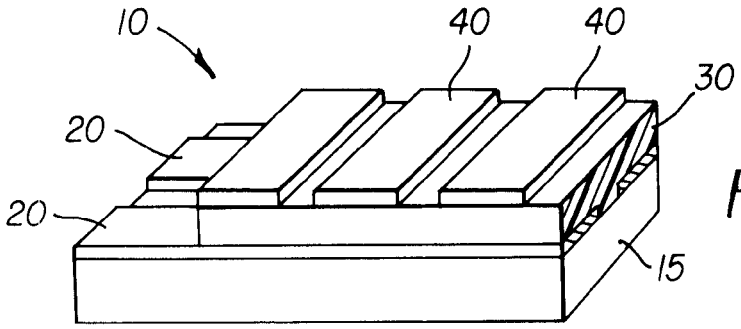
FIG. 2 is a perspective view of a cholesteric liquid crystal display.

FIG. 2 depicts an exemplary structure for a cholesteric liquid crystal display 10. Display 10 can include a substrate 15, which can be glass, a polymer, or other suitable material. For example, the substrate 15 can be a thin, transparent, polymeric material, for example, a polyester plastic such as Kodak Estar film base, or a polycarbonate. The substrate can be transparent. The substrate can have a thickness of between 20 and 200 microns, for example, about 125 microns.

Electrodes in the form of first patterned conductors 20 can be formed over substrate 15. First patterned conductors 20 can be any electrically conductive material, for example, copper, aluminum, or nickel. If first patterned conductors 20 are opaque material, the material can be a metal oxide so that the first patterned conductors 20 are light absorbing. First patterned conductors 20 can be tin-oxide or indium-tin-oxide (ITO). The material of first patterned conductors 20 can be formed as a layer over substrate 15 by any suitable technique, for example, coating, printing, vapor or thin film deposition, or sputtering. The layer can be patterned to form first patterned conductors 20 in any known manner, for example, by photolithography, skiving, laser etching, or chemical etching. The first patterned conductors 20 can have a resistance of less than 250 ohms per square.

A light modulating material 30 such as a polymer dispersed cholesteric layer can overlay first patterned conductors 20. The polymer dispersed cholesteric layer 30 can include a polymeric host material with dispersed cholesteric liquid crystal materials, such as Merck BL112, BL118, or BL126, available from E.M. Industries of Hawthorne, N.Y., or those disclosed in U.S. Pat. No. 5,695,682. Application of electrical fields of various amplitude and duration can drive a chiral nematic material into a reflective state, a transmissive state, or an intermediate state. These cholesteric materials have the advantage of maintaining a given state indefinitely after the field is removed.

The polymeric host material can be deionized photographic gelatin or another organic binder such as polyvinyl alcohol (PVA) or polyethylene oxide (PEO). The liquid crystal material can be dispersed in the deionized gelatin. For example, an 8% concentration of liquid crystal material such as BLI 18, can be dispersed in a 5% deionized gelatin aqueous solution to create domains of the liquid crystal in an aqueous suspension. The dispersion 30 can be coated over the patterned first conductors 20. The dispersion can be coated on the patterned first conductors 20 by known methods, including equipment associated with photographic films.

Electrodes in the form of second patterned conductors 40 can overlay polymer dispersed cholesteric layer 30. In use, second patterned conductors 40 can be supplied with sufficient conductivity to establish an electric field across polymer dispersed cholesteric layer 30. Second patterned conductors 40 can be formed using materials such as aluminum, silver, platinum, carbon, tungsten, molybdenum, tin, indium, or combinations thereof, by means known in the art, such as vacuum deposition. Oxides of the metals can be used to form darkened second patterned conductors 40 to absorb light. Tin-oxide or indium-tin-oxide coatings permit second patterned conductors 40 to be transparent. Electrodes 20 and 40 on opposite sides of the layer 30 and can form rows and columns, respectively. The intersection of a row and column defines a pixel for applying an electric field.

Second patterned conductors 40 can be formed by printing conductive ink, for example, Electrodag 423SS screen printable electrical conductive material from Acheson Corporation. Such printed materials are finely divided graphite particles in a thermoplastic resin. The second patterned conductors 40 can be formed using the printed inks to reduce display cost. Forming the display 10 by using a flexible support for substrate 15, laser etching material to form first patterned conductors 20, machine coating polymer dispersed cholesteric layer 30, and printing second patterned conductors 40 results in very low display fabrication costs.

Figure 3A:
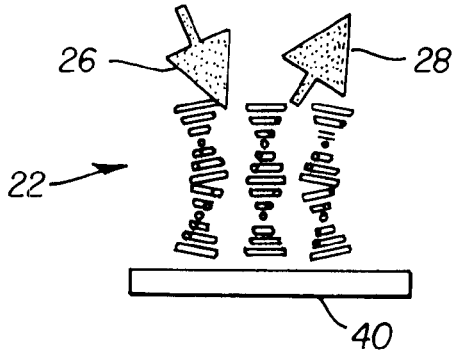
FIG. 3A is a schematic of a cholesteric liquid crystal material in a planar state reflecting light.
Figure 3B:
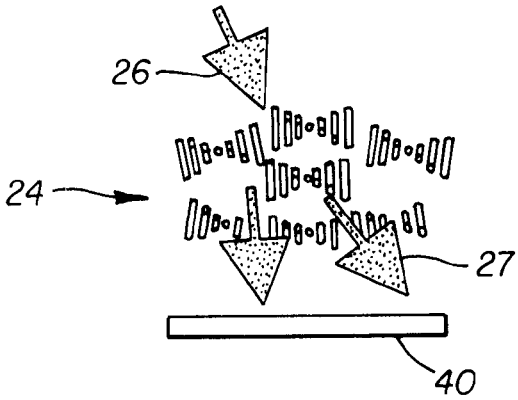
FIG. 3B is a schematic of a cholesteric liquid crystal material in a focal conic state forward scattering light.
Figure 3C:
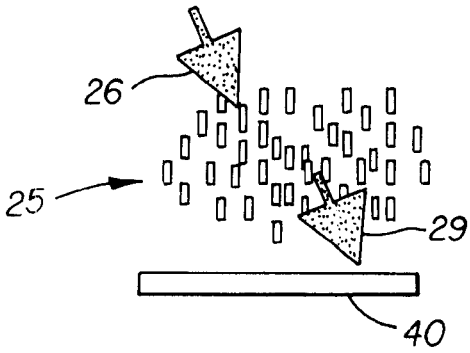
FIG. 3C is a schematic of a cholesteric liquid crystal material in a homeotropic state transmitting light.

FIG. 3A and FIG. 3B show two stable states of cholesteric liquid crystals. In FIG. 3A, a high voltage field has been applied and quickly switched to zero potential, which converts the cholesteric liquid crystals to a planar state 22, regardless of initial state. Incident light 26 having a specified wavelength and polarization striking cholesteric liquid crystals in planar state 22 is reflected as reflected light 28 to create a bright image. In FIG. 3B, application of a lower voltage field leaves the cholesteric liquid crystals in a transparent focal conic state 24, regardless of initial state. Incident light 26 striking cholesteric liquid crystals in focal conic state 24 is forward scattered. Second patterned conductors 40 can be black to absorb forward scattered light 27 and create a dark image when the liquid crystal material is in focal conic state 24. As a result, a viewer perceives a bright or dark image depending on whether the cholesteric material is in planar state 22 or focal conic state 24, respectively. The cholesteric liquid crystal material also displays a plurality of reflective states or textures when a part of the cholesteric material is in planar state 22 and the rest is in focal conic state 24. A viewer can perceive gray level images when closely spaced areas ("domains") of the liquid crystal material are manipulated to display different reflective states. Multiple domains form a pixel. In FIG. 3C, cholesteric liquid crystals are in a homeotropic state 25 when a high voltage is applied. Incident light 26 illuminating cholesteric liquid crystals in homeotropic state 25 is transmitted as transmitted light 29.

Figure 3D:
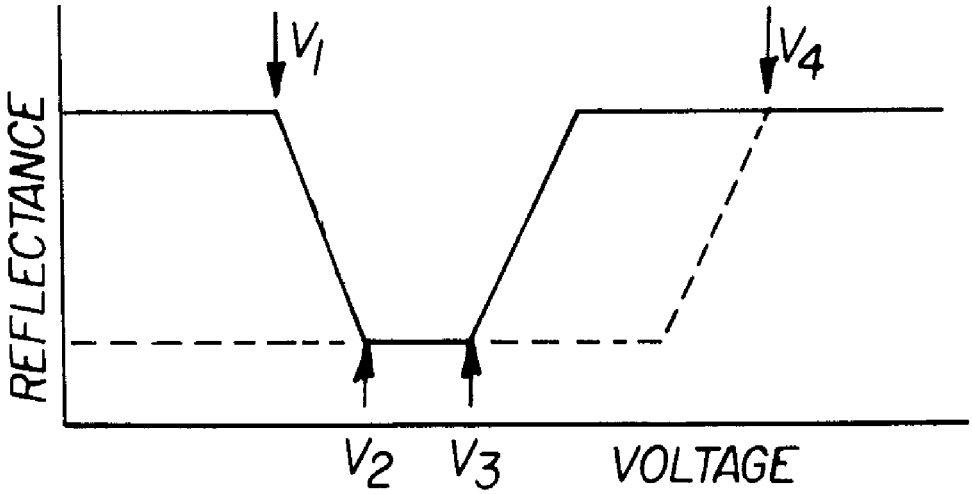
FIG. 3D (Prior Art)
FIG. 3D is a plot of the response of reflectance of a cholesteric liquid crystal material to a pulsed voltage (prior art)

FIG. 3D illustrates the state of the liquid crystal material after the application of various driving voltages thereto. The liquid crystal material can begin in a first state, either the reflecting planar state 22 shown in FIG. 3A or the non-reflecting focal conic state 24 shown in FIG. 3B, and can be driven with an AC voltage having a root mean square (RMS) amplitude above V4, as shown in FIG. 3D. When the voltage is removed quickly, the liquid crystal material switches to the reflecting state and will remain reflecting. If driven with an AC voltage between V2 and V3, the material will switch into the non-reflecting state and remain so until the application of a second driving voltage. If no voltage is applied, or the voltage is well below V1, then the material will not change state, regardless of the initial state. The application of voltages below V1 will create optical effects but will not cause a switch in the state of the material.

The driving scheme can use pulse trains with only two voltage levels: U or 0. One voltage source at one voltage can be used for the drive scheme. Circuits and systems for generating pulse trains with different voltage levels for the rows or columns to drive cholesteric liquid crystal displays depending upon the driving scheme are well known. Examples include those described in U.S. Pat. Nos. 6,154,190 and 6,268,840. These circuits and systems can be adapted for use with a single voltage source supplying two voltage levels.

Figure 4:
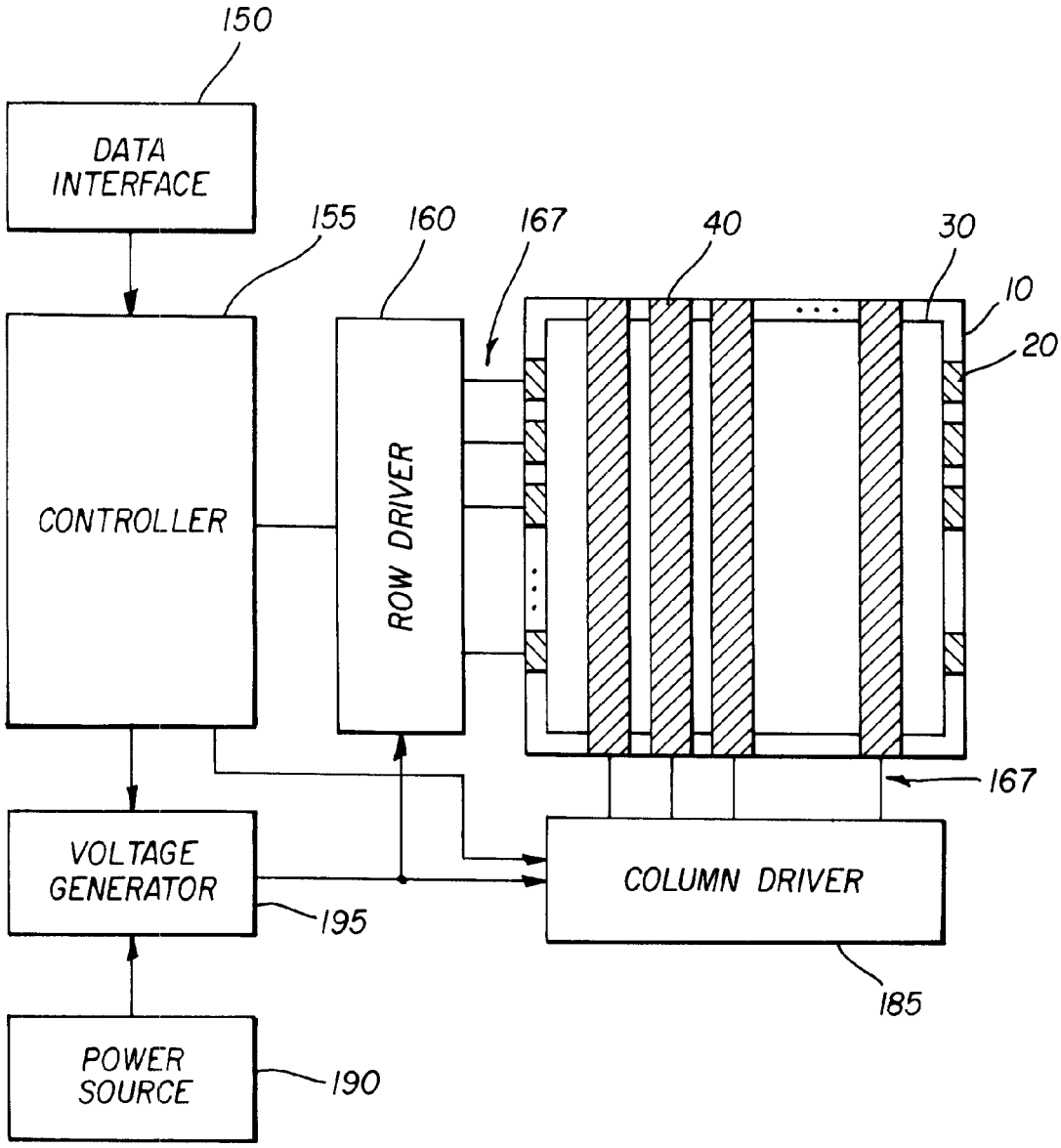
FIG. 4 is a system diagram with separate row and column drivers.

FIG. 4 shows a display system having a power source 190 providing power to a voltage generator 195. Examples of power sources can include batteries, solar cells, ac power or other means. The voltage generator 195 is responsible for converting the power from the power source into useable voltages, such as U and other voltages needed to power various system circuits. Data interface 150 can receive information from an external source, wherein the information can contain details of what the display 10 will show after the writing process. Controller 155 can receive data from the data interface 150 to determine the correct voltage waveforms to be presented to the first patterned conductors 20 and the second patterned conductors 40 to drive the display. Row driver 160 and column driver 185 can be supplied with voltage U from the voltage generator 195. The voltages U or 0V can be selectable on each output of the row driver 160 and column driver 185 by the controller 155. The controller 155 can be responsible for supplying the correct control signals to the row driver 160 and the column driver 185, as well as the correct timings of the desired waveforms. Outputs of the row driver 160 and column driver 185 are routed to the first patterned conductors 20 and second patterned conductors 40, respectively, through interconnects 167.

Figure 5:
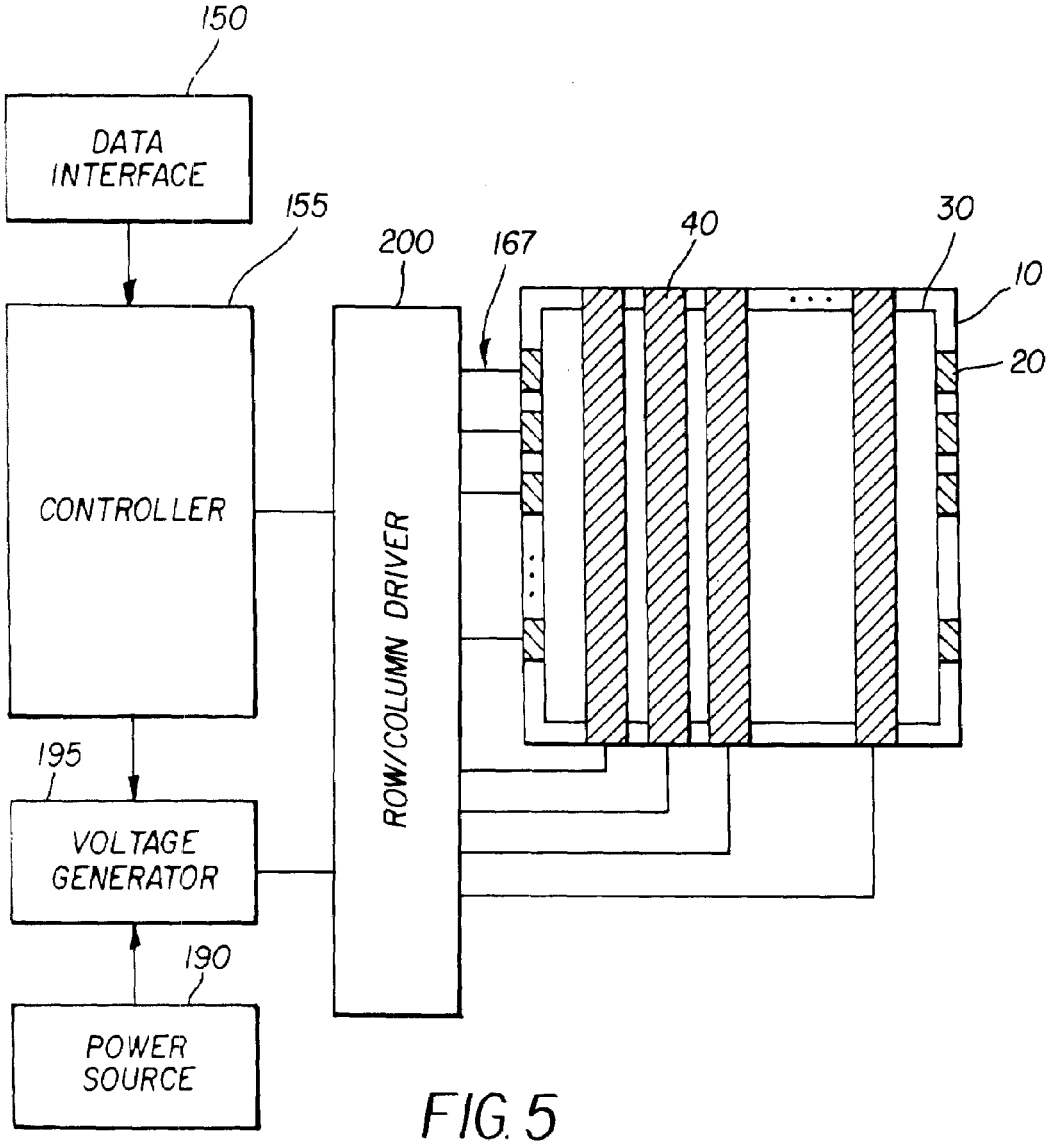
FIG. 5 is a system diagram with a common row and column driver.

FIG. 5 depicts a display system similar to that of FIG. 4, with the exception that the first patterned conductors 20 and second patterned conductors 40 can be driven from a common driver. Because both sets of patterned conducts 20 and 40 can be driven with two voltages, 0V and U, a common driver can be utilized. This can reduce the cost of the system.

Figure 6:
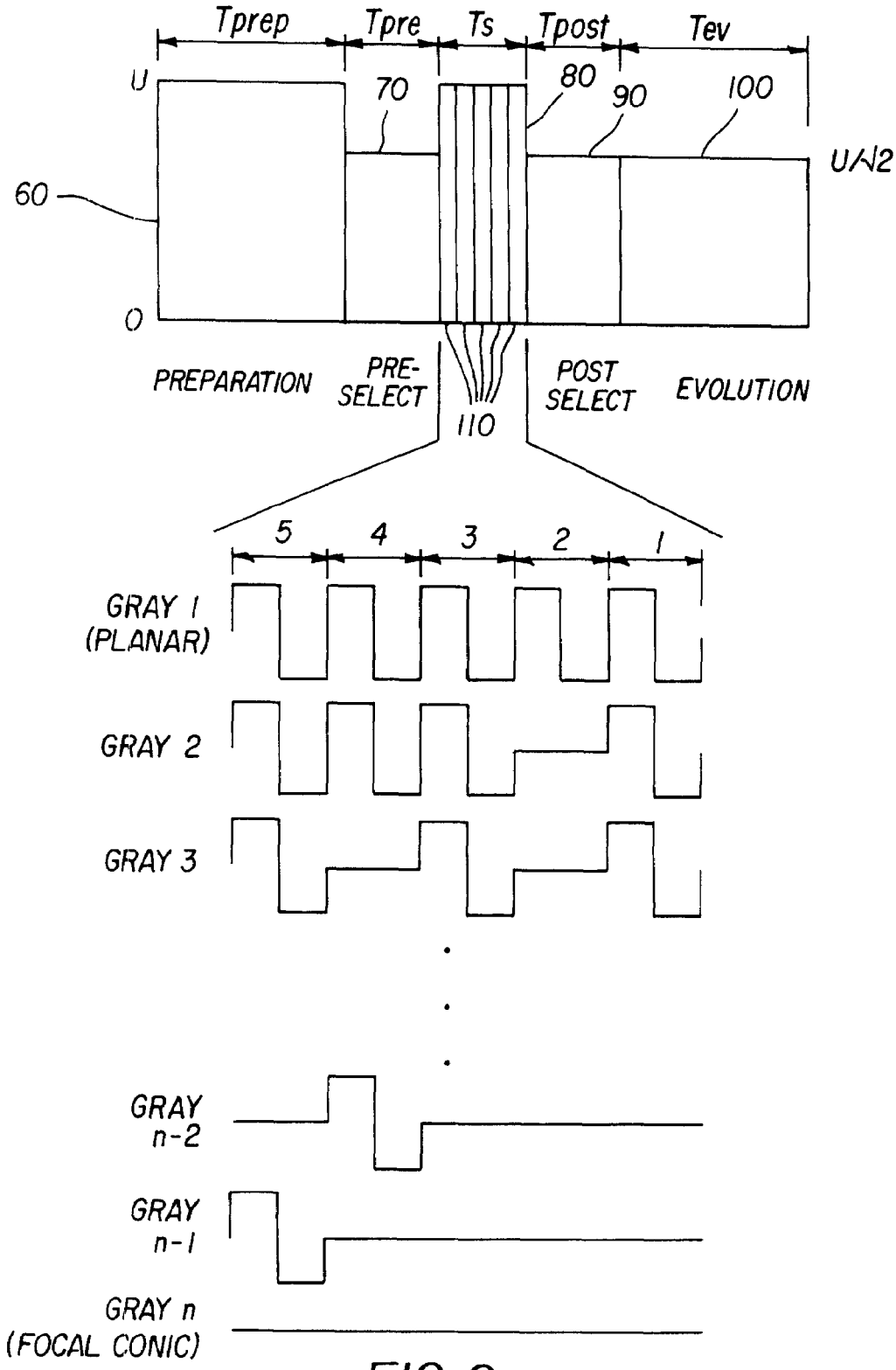
FIG. 6 is a phase diagram of a driving scheme with an exploded view of the selection phase.

FIG. 6 is a phase diagram of a drive scheme. The drive scheme first applies a preparation waveform to the entire display during the preparation phase 60. This resets the cholesteric liquid crystals, ChLC, of display 10 into the homeotropic state regardless of the previously written state. After a period of preparation time, Tprep, the drive scheme implements the pre-selection 70, selection 80 and post-selection 90 phases simultaneously.

First patterned conductors 20 not yet addressed are said to be in pre-selection 70, whereby voltage waveforms are applied with a 50% duty cycle with a resultant RMS voltage of $U/\sqrt{2}$. Due to the hysterysis of the ChLC, this voltage holds the ChLC of display 10 in the homeotropic state until they are ready to be addressed.

The selection phase 80 can be accomplished by addressing one group of pixels associated with an intersection of one first patterned conductor and all second patterned conductors for a selection time, Ts. After the selection time Ts has passed, another group of pixels associated with an intersection of a different first patterned conductor and all second patterned conductors can be addressed for a second selection time Ts. It is during the selection phase 80 that the final state of the pixels of display 10 are determined. The selection phase occurs individually on all first patterned conductors 20 until all have been addressed. After the selection phase 80, the post-selection phase 90 begins.

In the post-selection phase, the ChLC of display 10 can be held in the homeotropic state if, during the selection phase 80 ChLC of display 10 were held in the homeotropic state. If the CHLC of display 10 were allowed to relax out of the homeotropic state into the transient planar state during the selection phase 80, the post-selection phase 90 can allow the ChLC of display 10 to evolve into the focal conic state. The voltage waveform of the post-selection phase has a RMS voltage of $U/\sqrt{2}$.

After the post-selection phase 90, the evolution phase 100 enables any cholesteric liquid crystals of display 10 that may be in transient planar state to evolve into a focal conic state over the period of evolution, Tev. After the evolution phase 100 for the final first conductor is completed, all power can be removed from the display 10. Any ChLC of display 10 held in the homeotropic state throughout the writing process can relax through the transient planar state to the stable planar state.

Gray scale can be achieved in the selection phase 80, where the selection time, Ts, is divided into sub-selections 110, as shown in FIG. 6. The selection phase 80 can be sub-divided by any number n, where n must be at least 1. During any sub-selection 110, a voltage waveform for any pixel of the patterned conductor can have a voltage of either 0V or U. There may be as many as $2^n$ different combinations of 0 or U voltages during the entire selection time Ts. The sub-selection pulse widths can have an equal time subdivision, or they can be of different time subdivisions. The different patterns of pulses of 0V and U applied to the ChLC can alter the intrinsic relaxation of the ChLC from the hometropic state to the transient planar state. For example, a voltage of U can be periodically applied while the ChLC is relaxing to the transient planar state to drive the cholesteric liquid crystals toward a hometropic state during selection phase 80. At the end of the selection phase 80, domains of the ChLC of display 10 can be in a transient planar state due to the combinations of 0V and U applied. The domains in transient planar state can evolve into a focal conic state during post-selection phase 90 or evolution phase 100. The gray scale level is perceived by the number of closely spaced domains of ChLC that are in the stable planar state or the focal conic state.

Figure 7A:
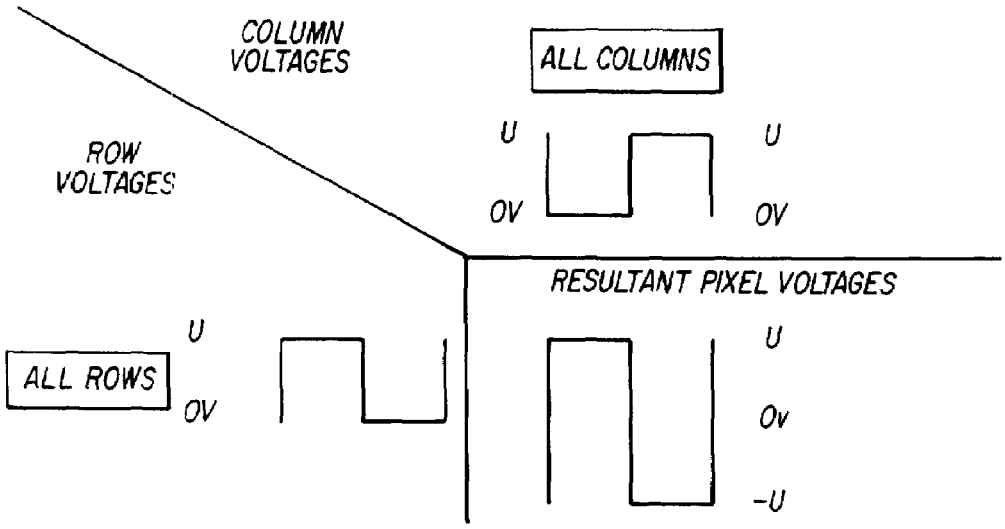
FIG. 7*a* is an illustration of the row, column, and resultant pixel waveforms during the preparation phase of the invention.
Figure 7B:
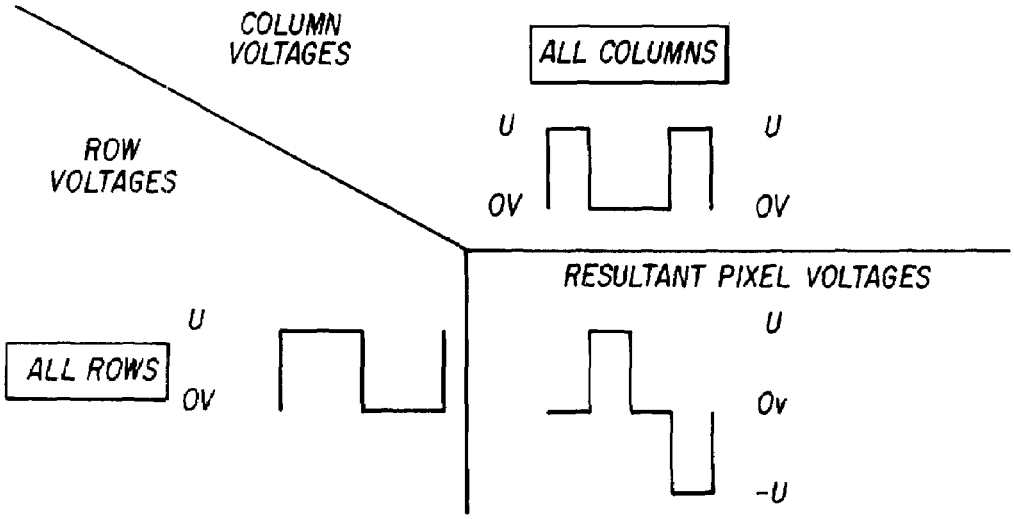
FIG. 7*b* is an illustration of the row, column, and resultant pixel waveforms during the evolution phase of the invention.
Figure 7C:
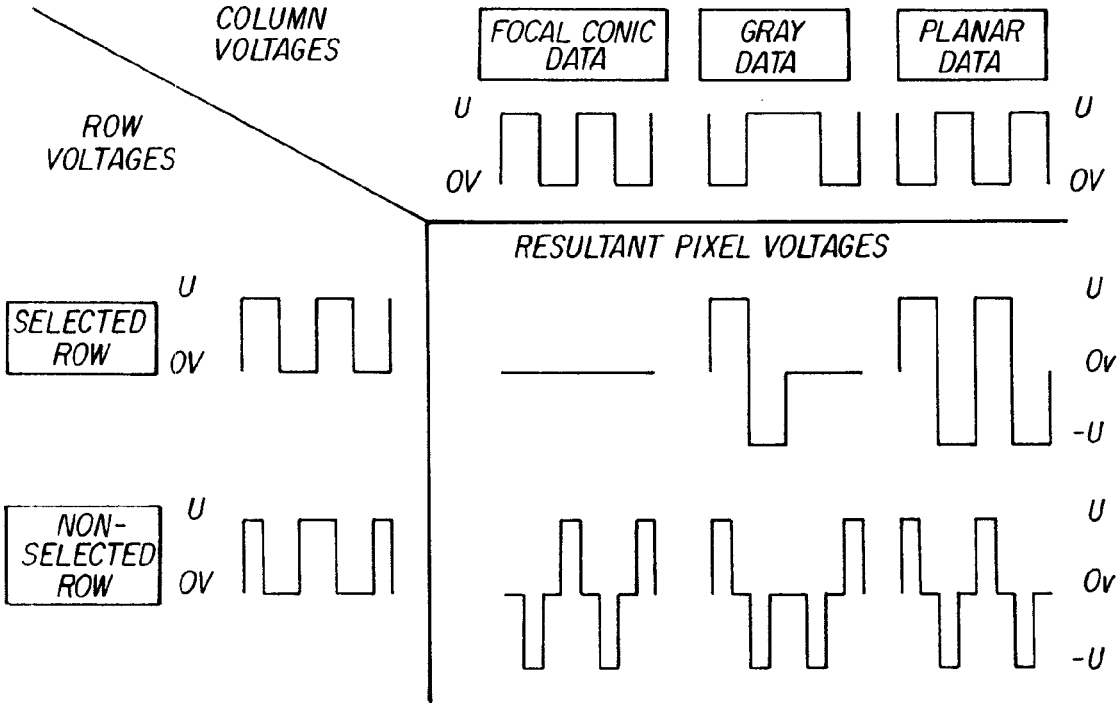
FIG. 7*c* is an illustration of the row, column, and resultant pixel waveforms during the pre-selection, selection, and post-selection phases of the invention.

FIG. 7*a* is a diagram of exemplary applied waveforms for the preparation phase 60 that can be applied to first patterned conductors 20 and second patterned conductors 40. The resultant pixel waveforms illustrate that the pixel voltages alternate between +U and −U, however the RMS voltage is U. FIG. 7*b* is a diagram of exemplary applied waveforms for the evolution phase 100 that could be applied to first patterned conductors 20 and second patterned conductors 40. The resultant pixel waveforms illustrate that the pixel voltage is $U/\sqrt{2}$. FIG. 7*c* is a diagram of exemplary applied waveforms that could be applied to the first patterned conductors 20 and second pattern conductors 40 for the phases of pre-selection 70, selection 80, and post-selection 90. In this example, the selection phase 80 has been divided into two sub-selection phases 110.

The voltages used in the described drive scheme can be formed using a unipolar driver or a bi-polar driver. According to certain embodiments, a unipolar driver is used to reduce cost and complexity of the driver.

Figure 8:
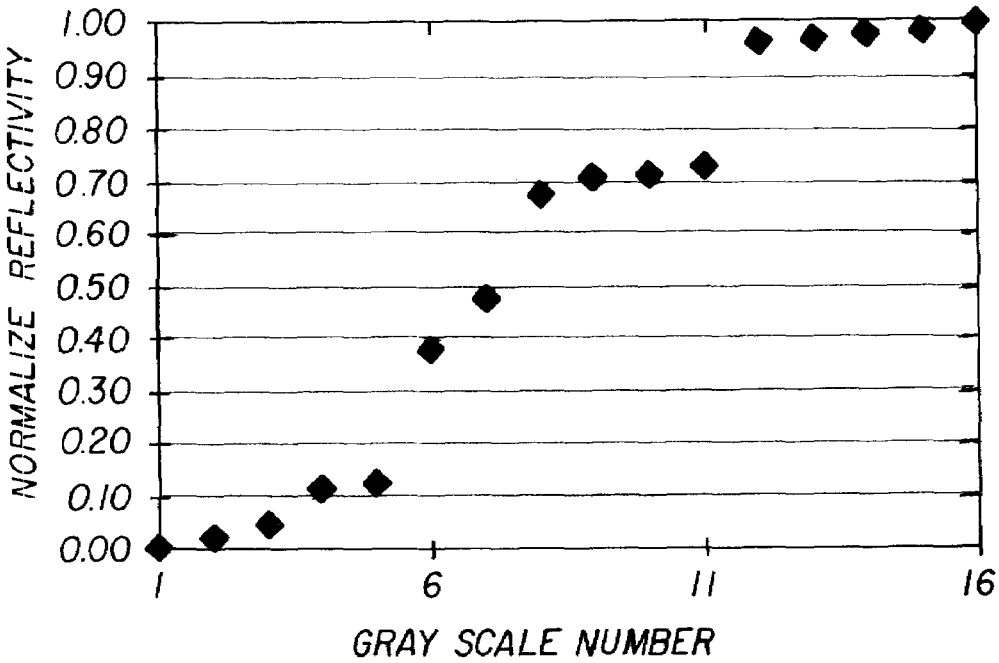
FIG. 8 is a graph of 16 various reflectance levels with equal sub-selection pulse widths.
Figure 9:
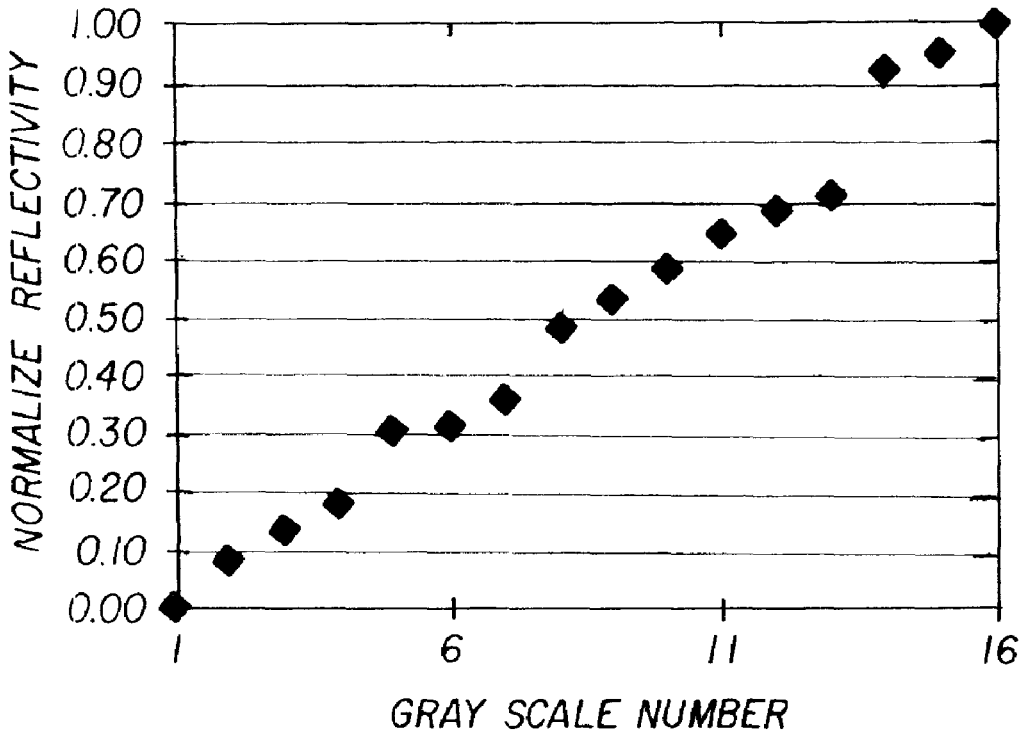
FIG. 9 is a graph of 16 various reflectance levels with unequal sub-selection pulse widths.

The methods described herein have been reduced to practice. Shown below are values obtained for equally and unequally spaced sub-selection pulses using the $2^n$ method exemplified in FIG. 6, wherein n is 5. Sixteen gray scale levels were achieved. The results are shown graphically in FIG. 8 and FIG. 9, respectively. The value represents the binary representation of the sub-selections, where a "1" indicates a waveform of U, and a "0" represents a waveform of 0V. For example, the value of "15" in binary is "01111."

Equal Sub-selections vs. Reflectance

| Value | Reflectance | Normalized Reflectivity |
|---|---|---|
| 31 | 2.69% | 0.00 |
| 15 | 2.92% | 0.02 |
| 30 | 3.37% | 0.05 |
| 23 | 4.28% | 0.12 |
| 7 | 4.37% | 0.12 |
| 29 | 7.89% | 0.38 |
| 14 | 9.20% | 0.47 |
| 27 | 11.97% | 0.68 |
| 19 | 12.39% | 0.71 |
| 11 | 12.50% | 0.72 |
| 3 | 12.68% | 0.73 |
| 13 | 15.89% | 0.96 |
| 12 | 16.00% | 0.97 |
| 6 | 16.11% | 0.98 |
| 21 | 16.22% | 0.99 |
| 0 | 16.41% | 1.00 |

Unequal Sub-selections vs. Reflectance

| Value | Reflectance | Normalized Reflectivity |
|---|---|---|
| 31 | 3.00% | 0.00 |
| 29 | 4.05% | 0.08 |
| 27 | 4.76% | 0.14 |
| 15 | 5.32% | 0.18 |
| 23 | 6.95% | 0.31 |
| 25 | 7.09% | 0.32 |
| 7 | 7.64% | 0.36 |
| 19 | 9.16% | 0.48 |
| 3 | 9.82% | 0.53 |
| 13 | 10.50% | 0.59 |
| 21 | 11.22% | 0.64 |
| 9 | 11.75% | 0.68 |
| 1 | 12.08% | 0.71 |
| 30 | 14.79% | 0.92 |
| 28 | 15.21% | 0.95 |
| 0 | 15.81% | 1.00 |

The invention has been described in detail with particular reference to certain preferred embodiments thereof, but it will be understood that variations and modifications can be effected within the spirit and scope of the invention.

PARTS LIST

| | |
|---|---|
| 1 | Preparation step |
| 2 | Selection step |
| 3 | Evolution step |
| 4 | Pre-holding step |
| 5 | Post-holding step |
| 10 | Display |
| 15 | Substrate |
| 20 | First patterned conductors |
| 22 | Planar state |
| 24 | Focal conic state |
| 25 | Homeotropic state |
| 26 | Incident light |
| 27 | Forward scattered light |

-continued

PARTS LIST

| | |
|---|---|
| 28 | Reflected light |
| 29 | Transmitted light |
| 30 | Polymer dispersed cholesteric layer |
| 40 | Second patterned conductors |
| 60 | Preparation Phase |
| 70 | Pre-selection Phase |
| 80 | Selection Phase |
| 90 | Post-selection Phase |
| 100 | Evolution |
| 110 | Sub-selection pulse |
| 150 | Data interface |
| 155 | Controller |
| 160 | Row driver |
| 167 | Interconnects |
| 185 | Column driver |
| 190 | Power source |
| 195 | Voltage generator |
| 200 | Common driver |

The invention claimed is:

1. A method of forming a gray scale of multiple gray levels on a bistable liquid crystal material having incremental reflectance properties disposed between a first and second plurality of electrodes, an intersection of the first and second plurality of electrodes forming a pixel having a pixel pulse voltage, the addressing method comprising:

applying a first number of pulses, wherein a voltage level of said pulses is at either predetermined levels of 0 volts or U volts only, to the first plurality of electrodes; and applying a second number of pulses, wherein a voltage level of said pulses is at either predetermined levels of 0 volts or U volts only, to the second plurality of electrodes, each of the pulses having a different frequency, wherein each pixel pulse voltage has a root mean square value of U volts.

2. The method of claim 1, wherein the first number and second number of pulses are the same.

3. The method of claim 1, wherein at least two of the number of pulses have the same frequency.

4. The method of claim 2, wherein at least two of the number of pulses have the same frequency.

5. The method of claim 1, wherein the first plurality and second plurality of pulses are applied while the liquid crystal material is relaxing from a homeotropic state to a transient planar state.

6. A method of forming a gray scale of multiple gray levels on a bistable liquid crystal material having incremental reflectance properties disposed between a first and second plurality of electrodes, an intersection of the first and second plurality of electrodes forming a pixel, the addressing method comprising:

applying a number of pulses, wherein a voltage level of said pulses is at either predetermined levels of 0 volts or U volts only, to the first plurality of electrodes; and applying the same number of pulses, wherein a voltage level of said pulses is at either predetermined levels of 0 volts or U volts only, to the second plurality of electrodes, wherein at least two of the number of pulses have the same frequency.

7. The method of claim 6, wherein each pulse has a root mean square value of U.

8. A method of forming a gray scale on a bistable liquid crystal material having incremental reflectance properties disposed between a first and second plurality of electrodes, an intersection of the first and second plurality of electrodes forming a pixel, the method comprising:

applying a first number of pulses, wherein a voltage level of said pulses is at either predetermined levels of 0 volts or U volts only, to the first plurality of electrodes;

applying a second number of pulses, wherein a voltage level of said pulses is at either predetermined levels of 0 volts or U volts only, to the second plurality of electrodes, wherein each pulse has the same voltage level.

9. The method of claim 8, wherein the first number and second number of pulses are the same.

10. The method of claim 8, wherein at least two of the number of pulses have the same frequency.

11. A method of forming a gray scale of multiple gray levels on a bistable liquid crystal material having incremental reflectance properties disposed between a first and second plurality of electrodes, an intersection of the first and second plurality of electrodes forming a pixel, the addressing method comprising:

a preparation phase;

a pre-selection phase;

a selection phase accomplished by:

addressing one group of pixels, associated with an intersection of one first patterned conductor and all second patterned conductors, for a selection time, Ts, where the selection time, Ts, is divided into sub-selections n, where n must be at least 1, by apply a number of pulses wherein a voltage waveform for any pixel of the one group of pixels within said sub-selection has a voltage level of either 0 volts or a predetermined RMS value of U volts and wherein there are as many as $2^n$ different combinations of pulses having a voltage level of 0 or U volts during the entire selection time Ts;

addressing a second group of pixels associated with an intersection of a different first patterned conductor and all second patterned conductors can be addressed for a second selection time Ts;

repeating said addressing until all groups of pixels are addressed;

a post-selection phase; and an evolution phase.

12. The method of claim 11, wherein said sub-selections are the same.

13. The method of claim 11, wherein at least two of said sub-selections are the same.

14. The method of claim 11, wherein said sub-selections are different.

* * * * *